US005590503A

United States Patent [19]

Spronken

[11] Patent Number: 5,590,503

[45] Date of Patent: Jan. 7, 1997

[54] NON-COMPOSITE PANEL

[75] Inventor: John R. Spronken, Calgary, Canada

[73] Assignee: Semper Sealing Systems Inc., Alberta, Canada

[21] Appl. No.: 141,504

[22] Filed: Oct. 26, 1993

[51] Int. Cl.[6] ..... E04C 5/16

[52] U.S. Cl. ..... 52/677; 52/713

[58] Field of Search ..... 52/712, 713, 600, 52/677; 248/499, 500, 680, 251, 262

[56] References Cited

U.S. PATENT DOCUMENTS

| | | | |
|---|---|---|---|
| 4,633,635 | 1/1987 | Anderson | 52/713 X |
| 4,660,347 | 4/1987 | Resan | 52/713 |
| 4,825,614 | 5/1989 | Bennett et al. | 52/712 X |
| 4,920,713 | 5/1990 | Borresen et al. | 52/713 X |

*Primary Examiner*—Lanna Mai
*Attorney, Agent, or Firm*—Keck, Mahin & Cate

[57] ABSTRACT

A panel to be applied to a building comprises a structural support and a concrete wythe located on one side of the support. Brackets are used to attach the wythe to the support, at least one of which permits relative sliding movement between the wythe and support. The one bracket is formed from a pair of overlapping members, one of secured to the wythe and the other of which is secured to the support. The overlapping members are dimensioned to allow relative sliding movement in the plane of the support.

12 Claims, 7 Drawing Sheets

NON-COMPOSITE PANEL

The present invention relates to panels intended to be applied to buildings.

It is well known to construct a structural framework for a building either from concrete and/or structural steel members and subsequently clad the building with facing panels. These panels may be made from a variety of materials but a common material is concrete with suitable reinforcements for structural integrity.

Previous attempts to provide concrete clad panels have attempted to attach a reinforced concrete wythe to a structural frame such as a steel stud so that a composite panel is formed. It is found however, that with such an arrangement the shrinking of the concrete relative to the steel stud as the concrete cured, resulted in bowing of the panel. Increasing the steel stud size and stiffness to limit such bowing however, results in cracking of the concrete wythe as the resulting induced tension in the concrete exceeds the tensile strength of the concrete.

It is therefore an object of the present invention to provide a panel construction in which a non-composite wall assembly is provided which permits the concrete wythe and the structural support to move relative to one another and thereby avoid inducing tensile loads in the concrete wythe.

In general terms therefore, the present invention provides a panel having a structural support and a concrete wythe located on one side of the support. Attachment brackets are used to secure the wythe to the support with at least one of the brackets permitting relative sliding movement between the wythe and the support.

It is preferred that the one bracket includes a first member secured to the wythe and having a base with a marginal wall defining an aperture that is directed towards the support. A second member having a central portion is received within the aperture and secured to the support. A peripheral portion of the second member overlaps the marginal wall on the opposite side of the base to the support. The central portion of the second member is spaced from the marginal wall of the aperture to allow limited movement relative thereto and has an abutment surface that is engageable with the support.

With the central portion abutting the support, the peripheral portion maintains a sliding relationship with the first member to permit relative sliding motion between the wythe and the support.

This has the benefit of substantially eliminating the bowing of the panel which results from differential shrinkage of the concrete relative to the supporting frame.

Embodiments of the invention will now be described by way of example only with reference to the accompanying drawings, in which FIG. 1 is a front elevation of a building having panels attached thereto;

Referring therefore to the drawings, a building generally indicated at 10 is clad with a number of panels 12 attached to the load supporting structure of the building. It will be appreciated that the panels 12 are shown as rectangular but may be designed to be of any convenient size and shape to cover the exterior of the load supporting structure.

Figure 1:
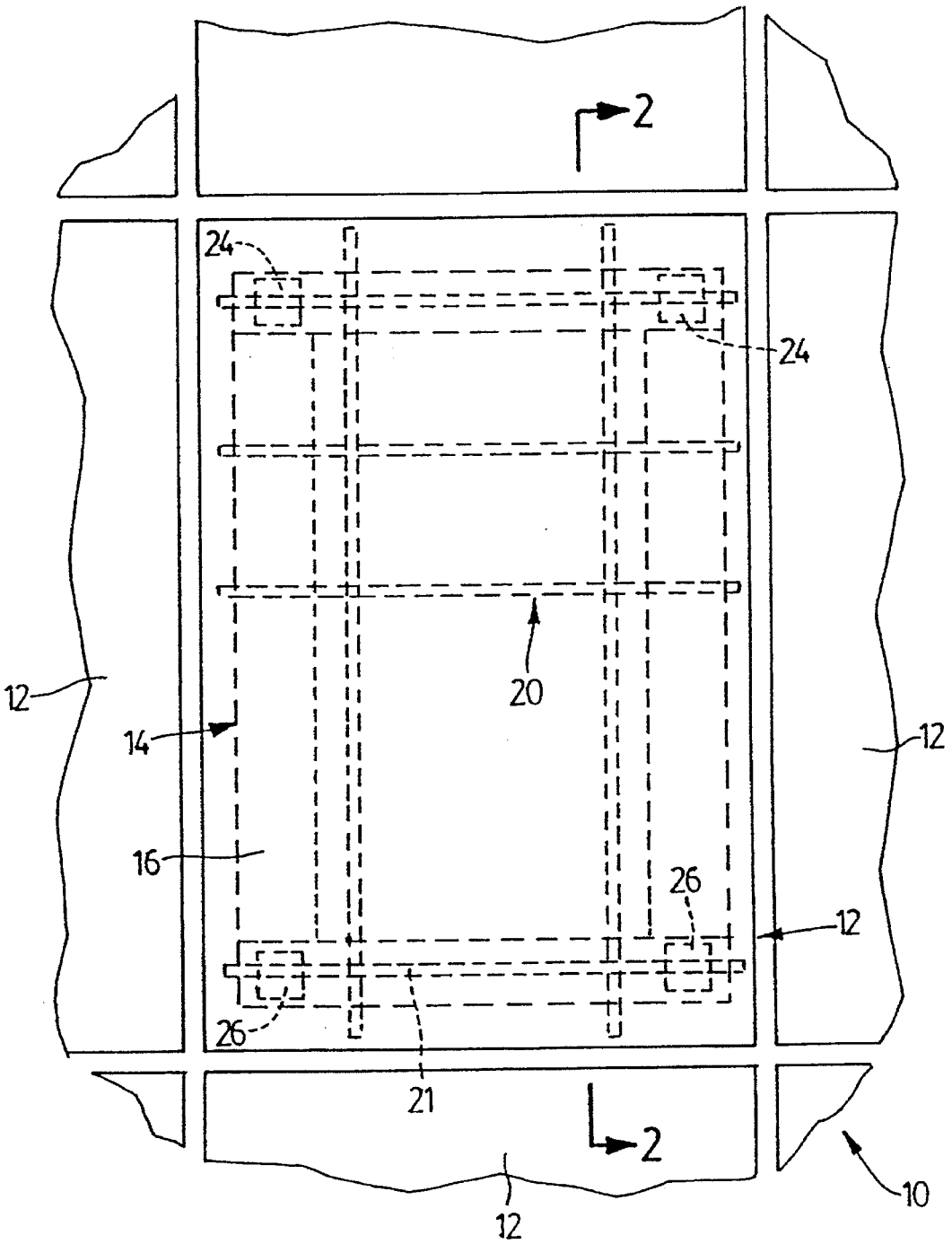
Figure 2:
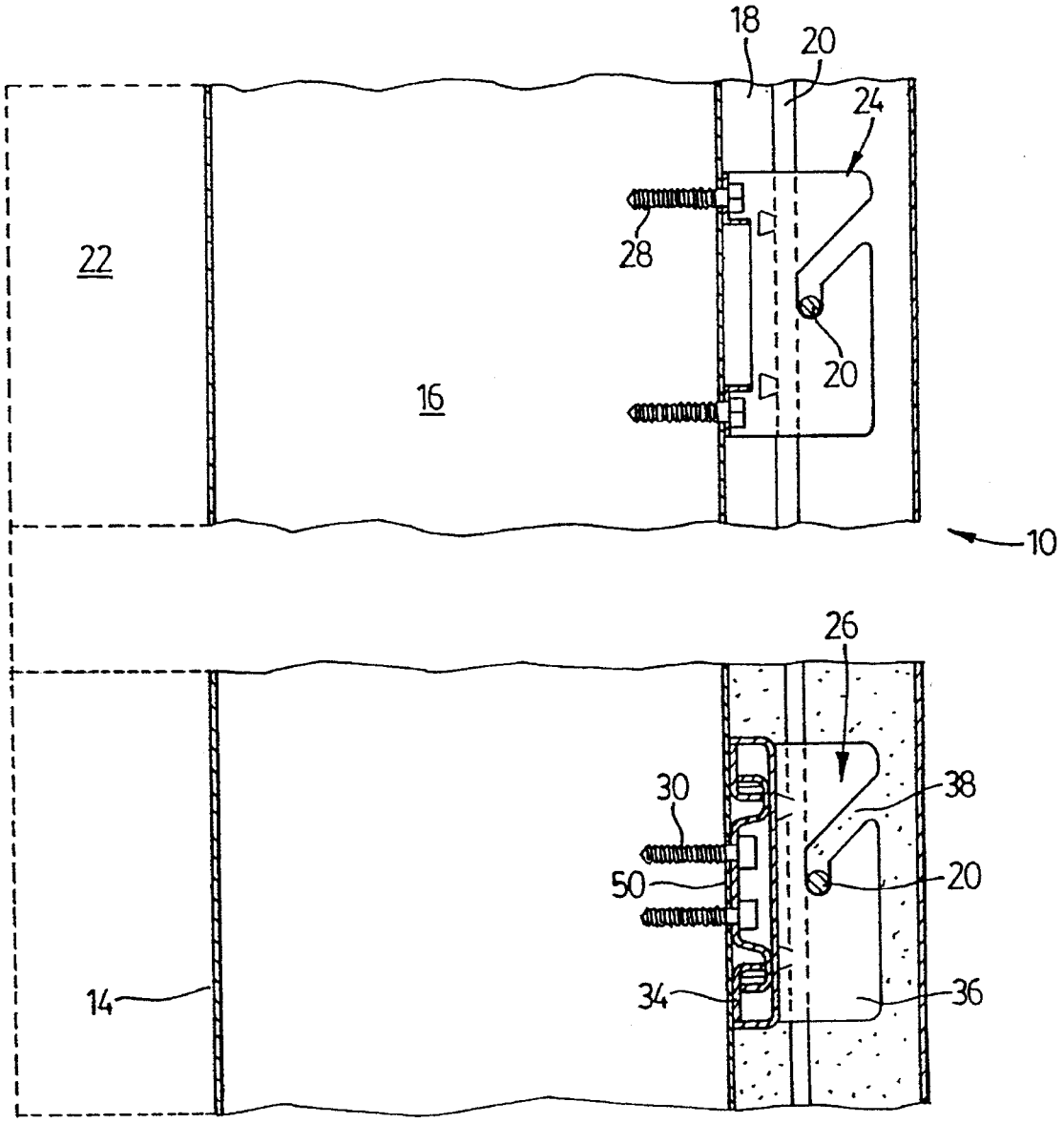
FIG. 2 is a view on the line 2—2 of FIG. 1.

Each of the panels 12 includes a structural support 14 which, in the embodiment shown in FIG. 1, is formed from a framework of steel frame members indicated individually at 16 which are connected to form a framework of the requisite pattern. As illustrated, the structural support 14 is shown as a simple rectangular framework made of channel section frame members having spaced parallel flanges 17 but it will be appreciated that additional frame members 16 or alternative sections may be incorporated to provide the desired strength in accordance with good building practice.

The panel 12 includes an outer wythe 18 formed from concrete and reinforced by a reinforcing mesh 20. The mesh 20 is formed from a grid of interconnected reinforcing bars 21 but may be made from individual bars 21 if appropriate. An inner wythe shown in ghosted outline at 22 may also be carried by the structural frame and this may be concrete or other material depending upon the particular application of the panel.

The wythe 18 is secured to the frame member 16 by a plurality of fixed brackets 24 and a plurality of floating brackets 26. The fixed brackets 24 are embedded within the wythe 18 and secured to the frame member through bolts 28. Relative movement between the bracket 24 and the frame member 16 is inhibited so that a relatively rigid connection is provided between the wythe 18 and the frame member 16.

The bracket 26 is also embedded within the wythe 18 and secured to the frame member 16 through bolts 30. However, the bracket 26 is configured to permit relative movement between the wythe 18 and the adjacent frame member 16 in directions parallel to the plane of the panel 12 as will be described in more detail below with reference to FIGS. 3 and 4.

Figure 3:
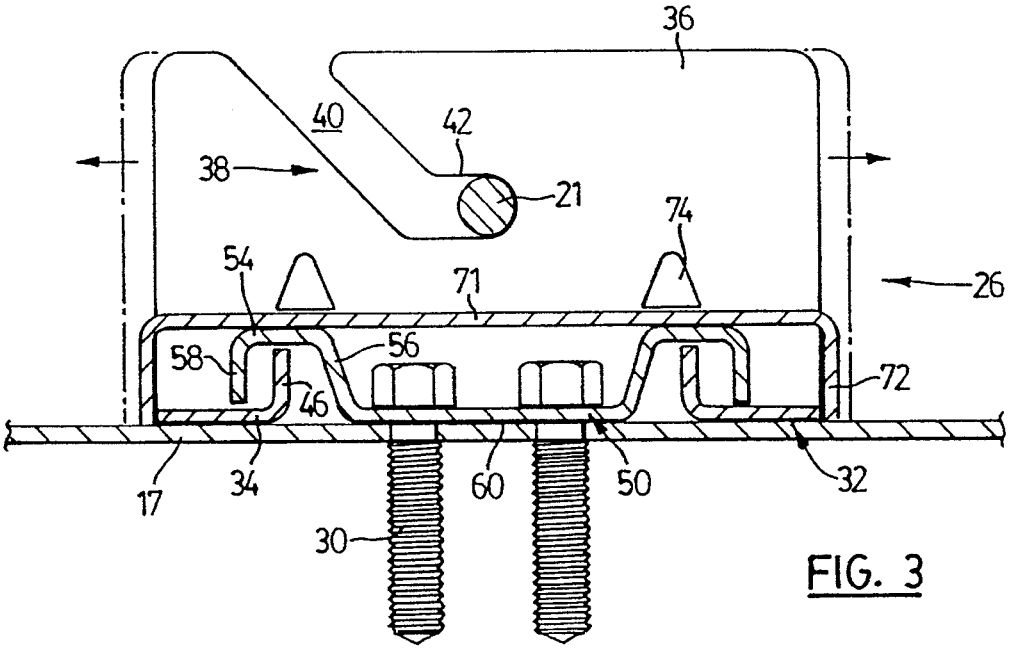
FIG. 3 is an enlarged view of a bracket shown in FIG. 2.
Figure 5:
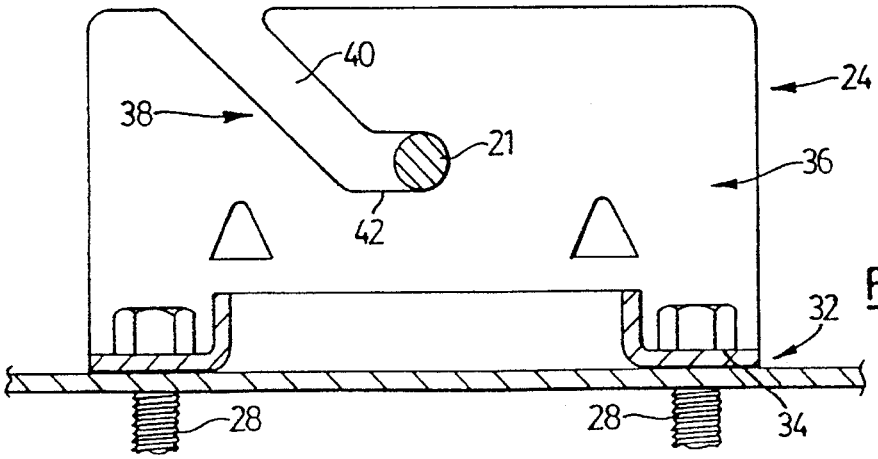
FIG. 5 is an enlarged view of another bracket shown in FIG. 2.
Figure 4:
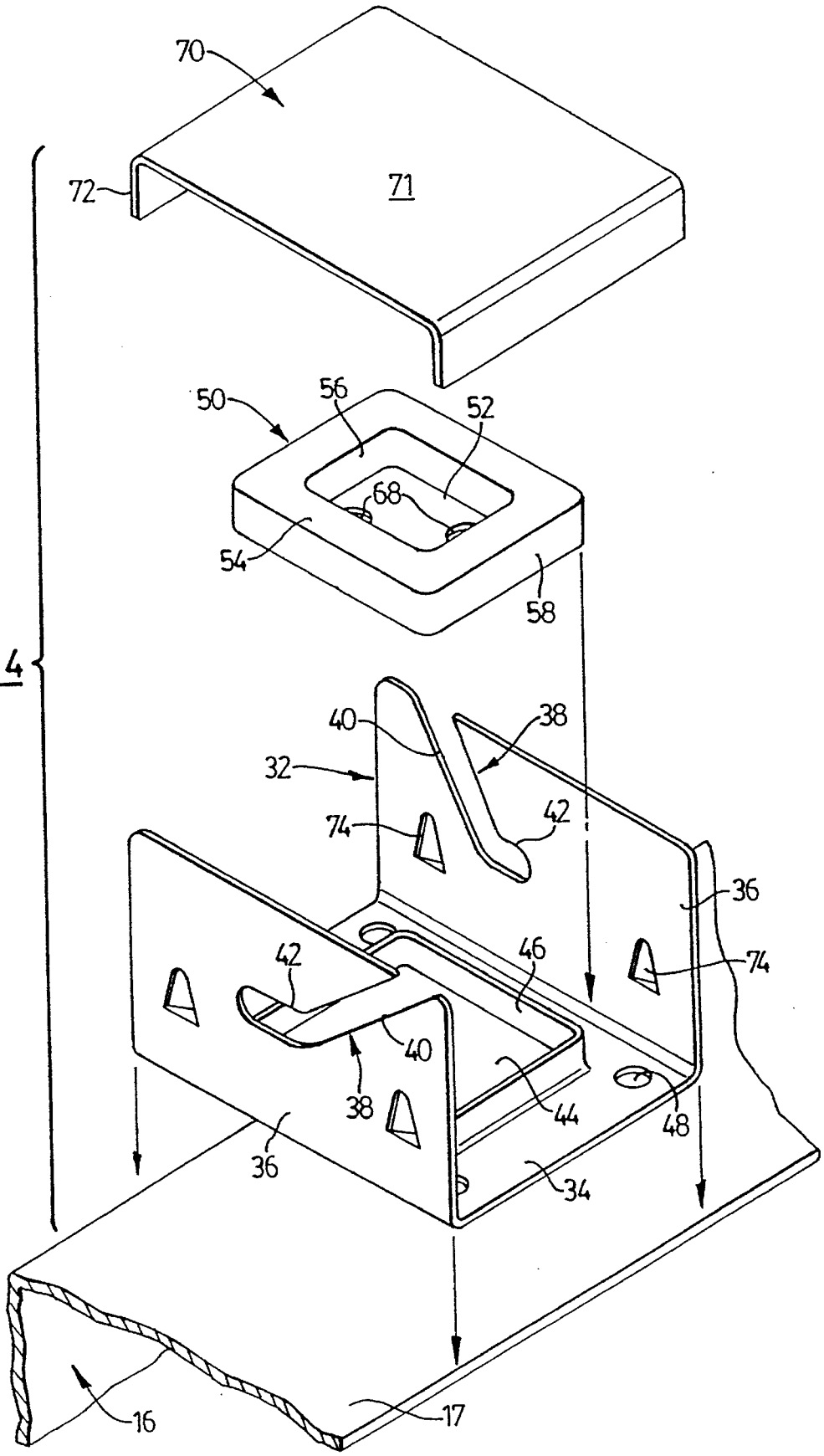
FIG. 4 is an exploded perspective view of the bracket shown in FIG. 3.

Referring therefore to FIGS. 3 and 4 each of the brackets 26 includes a U-shaped floating member 32 having a base 34 and a pair of upstanding legs 36. Each of the legs 36 is formed with a slot 38 having an entrance 40 extending at an inclined angle from the upper edge of the leg 36 to a terminal portion 42 that extends generally parallel to the base 34. The slot 38 is dimensioned to receive a reinforcing bar 21 and hold it securely within the terminal portion 42.

The slots 38 in the legs 36 are oriented in opposite directions so that the floating member 32 may be secured to the bar 21 by positioning the bar at the entrance of each slot and rotating the floating member 32 as the bar moves along the slot 38 to the terminal portion 42. Once secured in the terminal portion, the opposite orientation of the slots 38 inhibits displacement of the members 32 in planes parallel and perpendicular to the reinforcing bar 21.

The base 34 is formed with a central aperture 44 with an upstanding lip 46 defining the periphery of the aperture 44. The lip 46 projects upwardly from the base 34 and bolt holes 48 are provided in the base 34 adjacent each corner of the aperture 44.

The bracket 26 also includes a retaining member 50 which has a central depressed portion 52 and a marginal raised portion 54. A wall 56 extends between the portions 52,54 and a flange 58 extends around the periphery of the marginal portion 54 toward the base 34.

The central portion 52 is dimensioned to fit within the aperture 44 with a clearance between the wall 56 and the lip 46. The marginal portion 54 is spaced from the central portion 58 so as to extend across the lip 46 with the flange 58 being spaced from and extending about the lip 46.

A pair of bolt holes 68 are provided in the central portion 52 to receive the bolts 30 and hold the undersurface 60 of the central portion 52 in engagement with the flange 17 of the frame member 16.

The undersurface 60 thus provides an abutment to fix the spacing of the marginal portion 54 relative to the frame member 16.

A cover 70 is located between the legs 36 and is formed from a plate 71 with a pair of flanges 72 on opposite edges to space the plate 70 from the base 34. Each of the legs 36 is formed with a pair of detents 74 which engage the edges of the cover 70 and locate it between the legs 36.

To install the bracket 26 after it has been secured to the bar 21, the floating member 32 is positioned on the flange 17 of the frame members 16 with the cover 70 removed and the retaining member 50 positioned so that the central portion 52 lies within the aperture 44. The bolts 30 are then driven into the flange 17 of frame member 16 to secure the retaining member 50. The cover 70 is then located between the legs 36 to enclose the retaining member 50 within a cavity formed between the base 34, legs 36, plate 71 and flanges 72.

The wall 56 and the lip 46 are dimensioned such that with the undersurface 60 in abutment with the flange 17 the floating member 32 may slide relative to the retaining member 50. The dimensions of the marginal portion 56 accomodate limited movement in between the lip 46 and flanges 58 so that the base 34 is able to slide in the plane of the flange 17 but is held against movement in a direction normal to the plane of the flange 17.

A floating member 32 is also used on its own to provide the fixed bracket 24 which therefore consists of a base 34 with a pair of upstanding legs 36. The bolts 28 passing through apertures 48 to secure it directly to the flange 17 of the frame member 16. The bolts 28 located in the holes 48 prevent relative movement between the bracket 24 and member 16.

Figure 6:
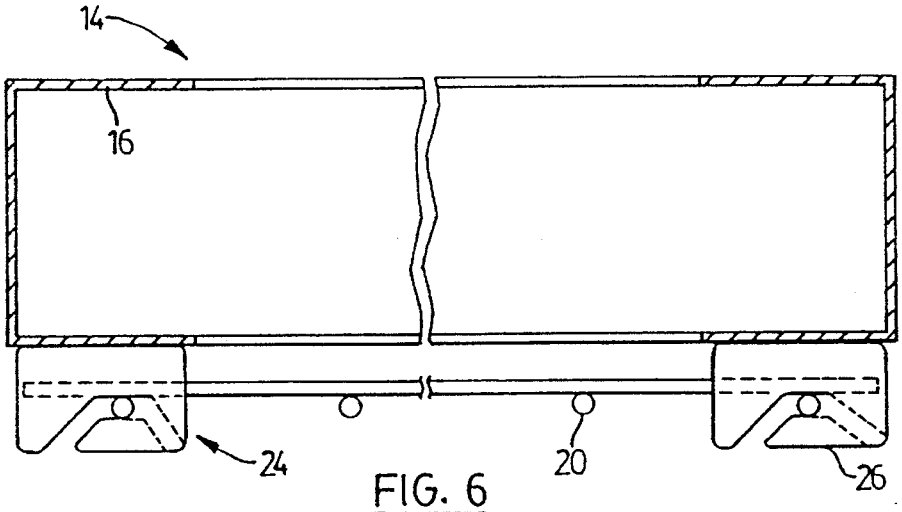
FIG. 6 is a schematic representation of the initial assembly of the panel shown in FIG. 2.

The formation of a panel using the brackets shown in FIGS. 3 and 4 is shown schematically in FIGS. 6 and 7. The frame 14 is initially assembled from the frame members 16. A row of fixed brackets 24 and floating brackets 26 are then attached to reinforcing bars 21 of the mesh 20 at the desired locations by twisting the base members 34 with the bar 21 in the slots 38.

The mesh 20 is then positioned over the frame 14 and the fixed brackets 24 secured to the respective frame members 16 by bolts 28 through the holes 48.

Figure 7A:
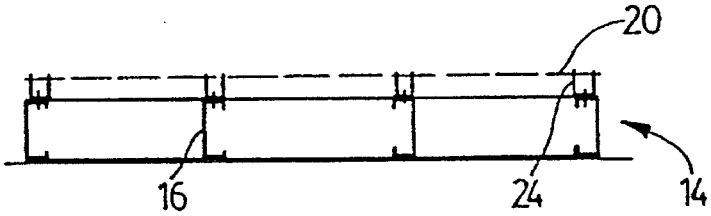
FIG. 7 is a schematic representation showing the stages of the process to assemble the panel.
Figure 7B:
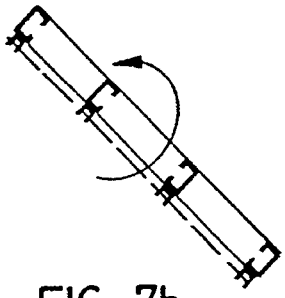
Figure 7C:
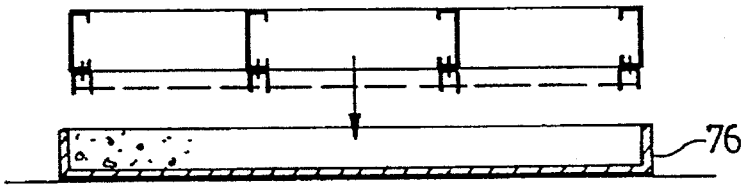
Figure 7D:
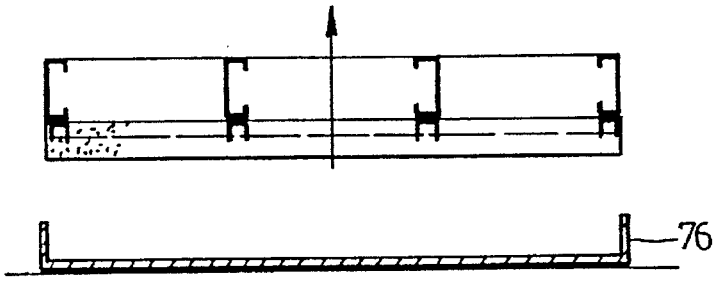
Figure 8A:
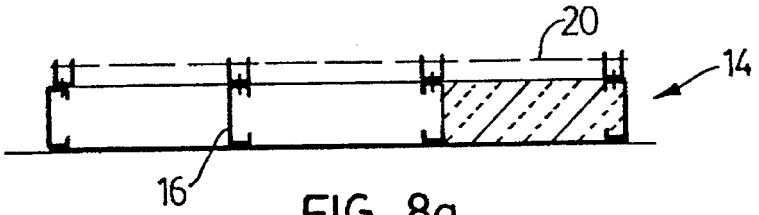
FIG. 8 is a view similar to FIG. 7 showing the process of forming a two sided panel.
Figure 8B:
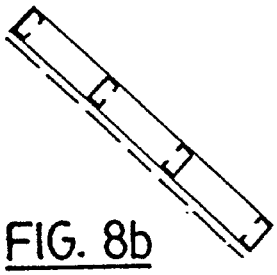
Figure 8C:
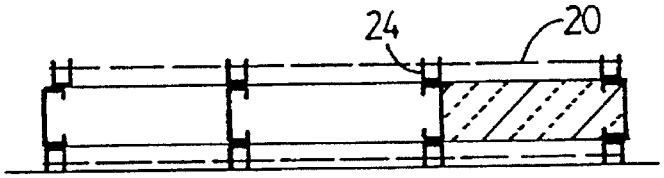
Figure 8D:
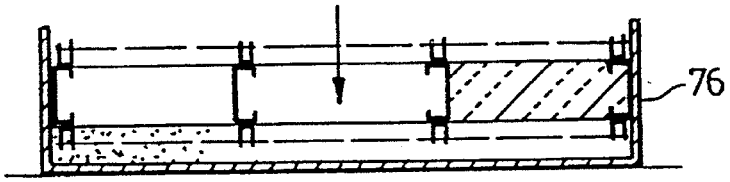
Figure 8E:
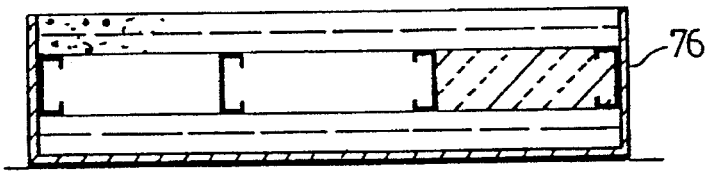
Figure 8F:
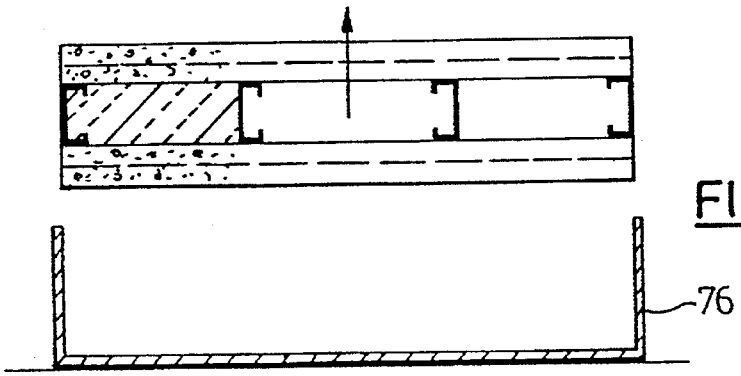

A fastening member 50 is then located within the aperture 44 of each of the floating brackets 26 and secured to the frame members 16 by bolts 28 in holes 68. With the brackets 24, 26 attached, the mesh is held securely in a spaced relationship to the frame 14 as shown in FIG. 6 and 7(*a*). With the mesh and frame assembled, the frame may be flipped (FIG. 7*b*), the mesh may then be introduced into the concrete forming the wythe 20 which has been poured into a form 76, shown in FIG. 7*c*. This form will have the requisite exterior features and the mesh will be introduced after the concrete has been poured but before it is cured so that the mesh is fully encased within the concrete. It will be noted that as the mesh is introduced, it is located within the body of the wythe 20, typically on the central plane of the wythe, by the slots 42 and the brackets 24,26 similarly are immersed within the concrete. The cover 70 on bracket 26 however, prevents the concrete from entering the cavity and inhibiting the requisite sliding action between the members 34,50. Once concrete has cured, the form 76 is removed (FIG. 7*d*).

A similar procedure may be used to form a double wythe panel as shown in FIG. 8. After the mesh 20 has been connected to one side of the frame 14 (FIG. 8*a*), the frame 14 is flipped and the interior of the frame 14 filled with a suitable insulating material. A second set of brackets 24,26 are attached to a second mesh 20 and then to the frame 14 (FIG. 8*c*). The frame 14 is then placed within a form 76 (FIG. 8*d*) to immerse the lower of the meshes within the concrete. Once that has cured, a second layer of concrete is applied over the upper mesh to be supported on the insulating material and encase the brackets and mesh (FIG. 8*c*). Once cured, the form 76 may be removed (FIG. 8*d*).

With the concrete wythe 20,22 cured, a unitary construction of panel 12 is formed which still permits individual adjustment of the components. As the concrete cures, the inevitable shrinkage of the concrete will be accomodated by the sliding action between the retaining member 50 and the base 34 so that stresses induced in the concrete are avoided. Similarly, once fully cured there will be inevitable expansion and contraction between the wythe 20 and the supporting structure 16 and the adjustable brackets 26 accomodate such movement.

The complete panel 12 may be attached to the building structure in any convenient manner. The frame 14 may be secured to the building structure using standard steel fixings common to the steel industry and this is particularly used.

Alternatively, the completed panel can be supported directly to the building structural frame using inserts cast into one of the concrete wythes. Such inserts can be of any suitable type, such as those commonly referred to as "Corewall" or "Helfen" or "Lancaster", common to the industry. The inserts cooperate with complementary fastenings provided on the building structure. In this instance, the frame 14 would act essentially as a stiffener but still allow relative movement between the wythes and frame.

At least one of the fixed brackets 24 is required to provide a secure location for the wythe 20 but the balance of the brackets may be adjustable brackets 26 so that the body of the wythe is floating relative to the frame. The structural integrity is maintained by the reinforcing bars 21 and the action of the brackets 26 to inhibit movement perpendicular to the frame. As a result, an extremely lightweight flexible panel is formed with induced stresses in the wythe being mitigated.

In general, a row of fixed brackets 24 will be provided that extends generally normal to the direction of shrinkage of the concrete. The floating brackets 26 are then located in an array to accomodate movement of the wythe relative to the frame 14.

Figure 9:
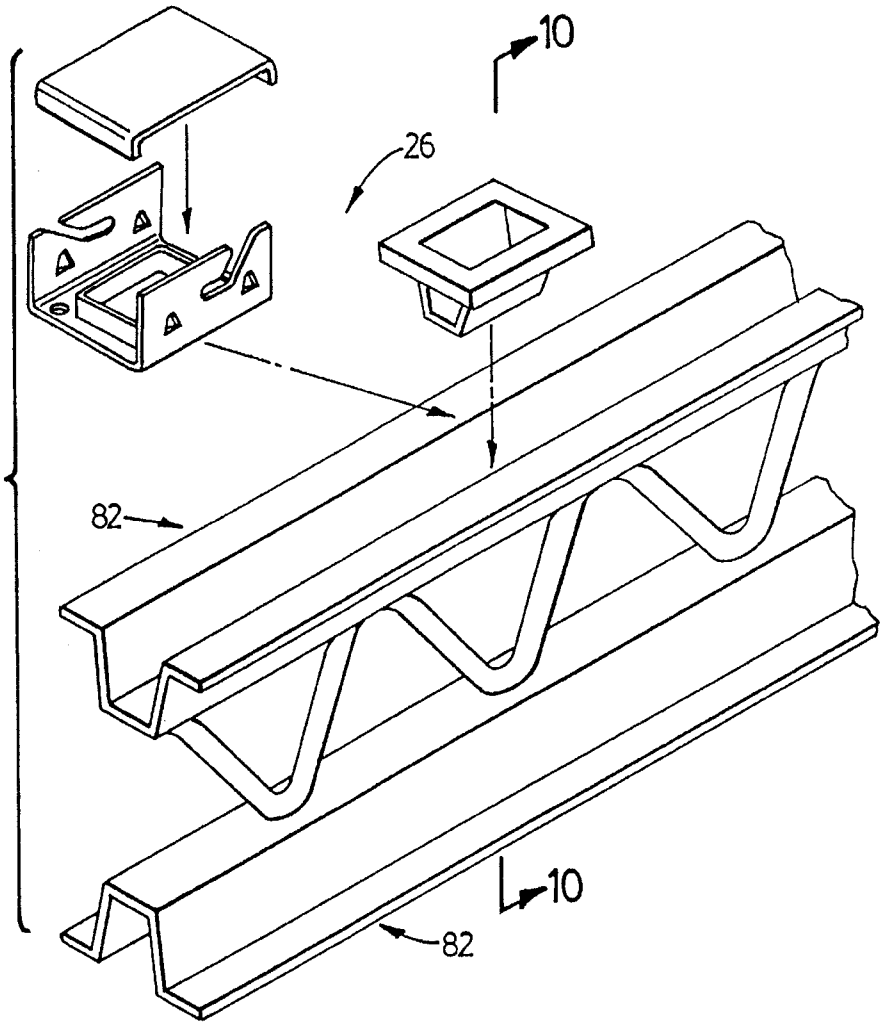
FIG. 9 is a perspective view of a further embodiment of panel assembly similar to that shown in FIG. 2.
Figure 10:
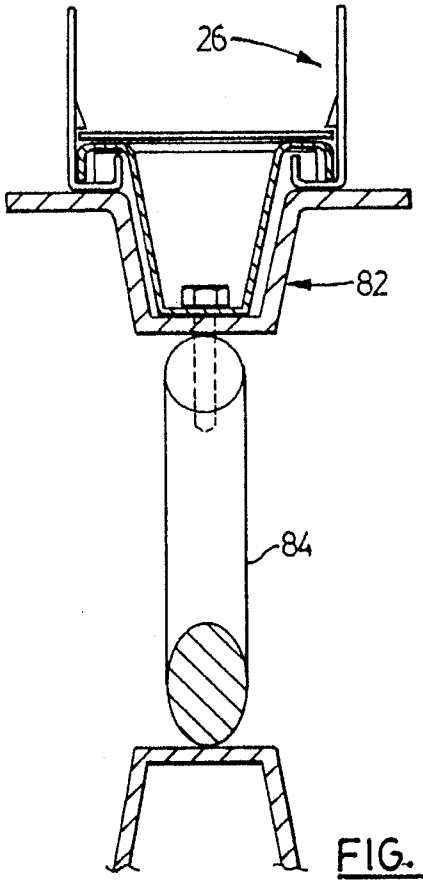
FIG. 10 is a view on the line 10—10 of FIG. 9.

The frame 14 in FIGS. 2 through 8, has been shown as made up of steel studs having a channel section. However, where greater structural rigidity is required for the frame alternative sections can be utilized such as that shown in FIGS. 9 and 10 where a fabricated beam 80 is used between the wythes 20,22. The beam includes a pair of channel members 82 maintained in spaced relationship by a serpentine web 84. The wythes 20,22 are secured to the channel members 82 by brackets 26*a* similar to those shown above with respect to FIG. 3. In this case, however, the retaining member 50*a* is configured to conform to the section of the channel member 82 so that its undersurface 60*a* again abuts the base of the channel 82 and locates the marginal portion relative to the base 34. In this way, sliding movement between the base 34 and the channel member 82 is maintained.

I claim:

1. A bracket for attaching a wythe to a structural support, said bracket comprising a first member having a base with a pair of oppositely directed surfaces and a pair of spaced legs extending from one surface of said pair of oppositely directed surfaces of said base, said base having an aperture therein and a marginal wall about the periphery of said aperture, a second member received between said legs and having a central portion received within said aperture and a peripheral portion juxtaposed with said one surface of said base, said central portion being spaced from said marginal wall and having an abutment surface to contact said marginal wall and maintain said peripheral portion in sliding relationship with said one surface of said base and thereby permit relative sliding movement between said wythe and said support, each of said legs including a slot having an entrant portion extending inwardly from a periphery of said leg to receive a reinforcing bar embedded in said wythe.

2. A bracket according to claim 1 wherein each of said slots includes a terminal portion extending generally parallel to said base to inhibit relative movement between said bar and said first member in a direction normal to said base.

3. A bracket according to claim 2 wherein each of said entrant portions extends from said terminal portion to a periphery of a respective leg and is inclined to said terminal portion to permit relative movement between said first member and said bar in a direction generally normal to said base to permit insertion of said bar into said slot.

4. A bracket according to claim 3 wherein said entrant portions of said slots extend in opposite directions from said terminal portions in respective ones of said legs, said bar being inserted into said slot by relative rotation between said first member and said bar.

5. A bracket according to claim 4 wherein said marginal wall includes a lip extending normal to said base about said aperture and on said one surface of said base.

6. A bracket according to claim 5 wherein said second member has a flange depending from said peripheral portion to overlie said lip.

7. A bracket according to claim 6 wherein a cover plate extends between said legs and over said second member.

8. A bracket according to claim 7 wherein said cover plate includes a pair of flanges directed toward said base and extending between said legs to enclose said second member within a cavity defined by said base, legs and cover plate.

9. A bracket according to claim 8, wherein said cover plate is retained by detents formed on said legs.

10. A bracket according to claim 1 wherein a plurality of apertures are formed through said central portion of said second member to receive fasteners.

11. A bracket according to claim 1 wherein a plurality of holes are formed in said base to receive fasteners.

12. A bracket according to claim 11 wherein said holes are uniformly distributed about said aperture.

* * * * *